United States Patent [19]

Halm

[11] 4,249,662

[45] Feb. 10, 1981

[54] DATA REGISTER

[75] Inventor: Hans Halm, Herne, Fed. Rep. of Germany

[73] Assignee: Confon AG, St. Gallen, Switzerland

[21] Appl. No.: 941,170

[22] Filed: Sep. 11, 1978

[30] Foreign Application Priority Data

Sep. 13; 1977 [DE] Fed. Rep. of Germany ..... 2741222
Aug. 19, 1978 [DE] Fed. Rep. of Germany ... 7824814[U]

[51] Int. Cl.[3] ..... B07C 3/20
[52] U.S. Cl. ..... 209/610; 209/613
[58] Field of Search ..... 209/610, 613

[56] References Cited

U.S. PATENT DOCUMENTS 4,129,215 12/1978 Halm ..... 209/610

*Primary Examiner*—Joseph J. Rolla
*Attorney, Agent, or Firm*—Toren, McGeady and Stanger

[57] ABSTRACT

The invention relates to a data register with a register card selection mechanism, whose selector keys connected with the swivel levers are arranged one behind the other and alongside one another in an opening of the housing in such a way that the width of each selector key corresponds to the width of the swivel levers, while the card restraining pins on each swivel lever are formed from U-shaped portions shaped onto the swivel lever end with a rod which engages from below in the register card opening, the drawer being open at the back and at both sides, whereby the two lateral drawer limiting walls are formed by two boundary walls shaped onto the inner wall surface of the housing cover and arranged on either side of the plate-shaped drawer base and whereby the swivel levers are guided on the end carrying the card restraining pin, while the drawer unlocking mechanism comprises a U-shaped shackle directly responsible for the locking and unlocking of the drawer.

1 Claim, 22 Drawing Figures

DATA REGISTER

Figure 1:
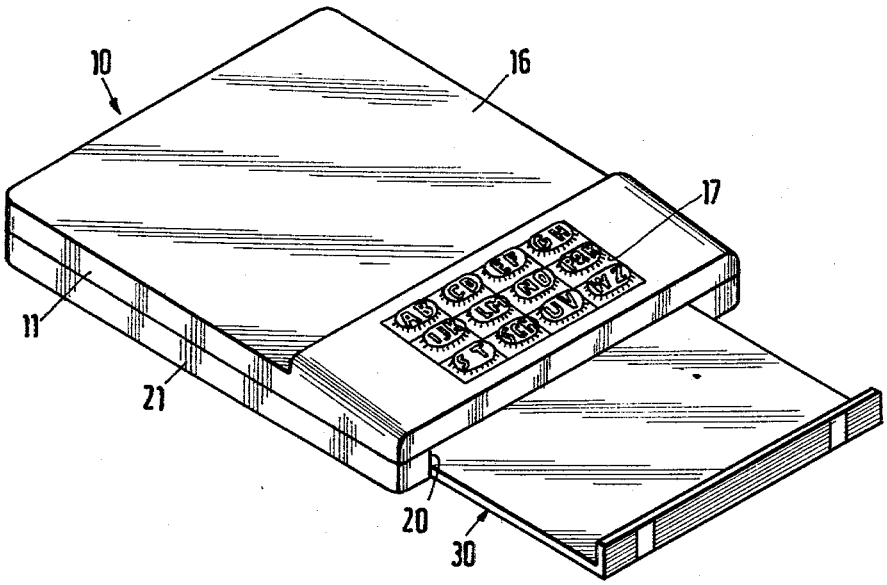

The present invention relates to a data register with a register card selection mechanism comprising a housing which has a cover and a base with a plurality of selector keys which are juxtaposed and superimposed in rows and a drawer which is under the action of a compression spring and which is closable by means of a locking mechanism, whereby a large number of register cards are stacked in said drawer with selection tongues having openings formed in the rear edge portions thereof, said tongues increasing in size in steplike manner by in each case one opening-containing selection tongue from one side to the other of the register card with the first opening to the opposite register card, whereby each selection key is fixed to a swivel arm constructed as a lever which at its free end carries a card restraining pin, whereby the card restraining pins of the swivel levers are arranged in a row and cooperate with the register cards in such a way that on depressing a selector key, all register cards located above the register card associated with this selector key are held back on extending the drawer by inserting the card restraining pins into the openings of the selection tongues of the register cards, whilst the selected register card and all the cards located below it are moved out with the drawer, as well as a device operable by the swivel levers of the selector keys for unlocking the drawer and releasing the register cards selected by a selector key by forcing out the unlocked drawer by means of the compression spring and provided with cams for engaging with cam perforations on the register card.

Various constructions of data registers with selection mechanisms are known. They comprise a housing for receiving a stack of loose register cards and a keyboard with correspondingly marked finger keys whose operation selects the desired cards. The register cards can contain random information for subsequent reference in alphabetical order. A known construction of a data register is made relatively flat in the closed state and is opened by means of a plurality of keys which are manually operated in order to open the desired register at the desired point, thereby making freely visible the information on the cards. The thus constructed data register is also provided with a closing key by means of which the cover which covers the register card can be transferred into the closed position, thereby simultaneously with the closing of the cover, the raised register cards are automatically returned to their initial position.

In addition, a data register is known which comprises a housing with a drawer for receiving the register cards which is closed by a bolt and is under the action of a thrust spring and a device for unlocking the drawer and releasing the register card selected by means of a set key by forcing out the unlocked drawer by means of the thrust spring.

These known data registers are constructed as standing devices and are placed on a support. The data register housing can also be provided with a surface which serves as a support for a telephone if the said housing is equipped with a drawer which moves the selected register card out of the housing.

However, it is common to all these data registers that the keyboard comprising a plurality of selector keys is arranged in the front area of the register, whereby the selector keys are juxtaposed in rows. In addition, the known data registers having relatively large dimensions are known.

In addition, a device for selecting one of the plurality of cards stored in a housing is known, said cards being selected by key pressure and horizontally stacked in a drawer arranged in an opening in the front wall of the housing and moved horizontally into the housing in a closed position and horizontally out of the housing in an open position in which it can be locked relative to an initial stress, to which end a latch with a shackle is provided which is movably secured in the housing and under an initial stress and engages in a notch in the drawer. In addition, a key lever is provided for each card which has a rod fixed in pivotable manner in the housing on whose one end is provided a manually operable key located outside the housing, whilst at the other end of the key lever is provided on one side a shoulder for unlatching the shackle on operating the key and on the other side a shoulder which cooperates with the cards having aligned recesses in such a way that on depressing the key all the cards above the card associated with said key are prevented from moving with the drawer, whilst the selected card and all the cards located below it are moved out with the drawer.

In the case of this known selection mechanism, a plurality of card cams corresponding to the number of cards is hinged to the drawer and by means of attachments arranged at the end of the key lever opposite to the key, said cams can be moved into an engagement position at the rear edge of the selected card and the cards located below it ondepressing the corresponding keys, whilst the attachment cooperating with the cards is constructed in such a way that it simultaneously engages in a recess of all the cards located above the selected card in order to prevent them from moving.

This known selection mechanism has a very complicated construction in view of the fact that a plurality of card cams corresponding to the number of cards is hinged to the drawer, which can be brought into the operating position by attachments on the key levers, whilst the attachment cooperating with the cards is constructed in such a way that it simultaneously engages in a recess of all the cards located above the selected cards in order to prevent any displacement thereof.

The problem of the present invention is to provide a data register which has very small dimensions, which is operationally reliable and permits a completely satisfactory separation of the selected register cards without significant technical expenditure.

According to the invention, this problem is solved by a data register of the type indicated hereinbefore wherein the card restraining pin of each swivel lever comprises an approximately U-shaped portion shaped onto the end of the swivel lever with a leg leading to the selector keys onto whose end is shaped a vertically upwardly directed rod which on operating a swivel lever engages from below into the register card opening or recesses, wherein for guiding the swivel lever each swivel lever is provided on the end carrying the card restraining pin with a vertical slot-shaped opening into which engages a cam shaped onto the inner wall surface of the housing cover and is guided in the opening, and wherein the mechanism for unlocking the drawer comprises a U-shaped shackle articulated to the cover of the housing and whose web which is at right angles to the longitudinal direction of the swivel lever rests on the top of the swivel arms and is subject to the action thereof, whilst each shackle member has a locking cam on its bottom face facing the drawer which cooperates with a counter-cam shaped onto the drawer in such a way that on raising the shackle on operating a selector key the locking cam is disengaged from the counter cam so that the drawer is extended outwards.

By means of the data register constructed according to the invention, a register card selection mechanism is provided which, due to the fewer components, namely housing, drawer, swivel levers with shaped selector keys and shaped card restraining pins and drawer unlocking mechanism by means of a swivel shackle operated directly by the swivel arms on the operation thereof which can be manufactured in a very economic manner. Due to the small number of components, assembly is easy and can also be performed by untrained staff.. The small number of structural parts is particularly advantageous when carrying out any repairs which may be necessary. The arrangement of the card restraining pins at the ends of the swivel levers in a recess formed in the base plate of the bottom of the housing permits a shallow construction of the data register. Even when the selector keys are operated incorrectly, incorrect selection is not possible because the ends of the swivel levers carrying the card restraining pins are individually guided on cams, so that a tilting or displacement of the end areas of the swivel levers is not possible. No additional devices are necessary for supporting the swivel arms in their initial position with spring-operated devices. The swivel levers ends with the card restraining pins are supported on the base plate on the bottom of the housing. The completely reliable operation of the data register is also ensured through the swivel arms for controlling the unlocking mechanism for the drawer being directly operable by the swivel arms on actuating the same without additional mechanical devices having to be provided. As the swivelling of each swivel arm is directly transferred to the swivel shackle, there is also a direct actuation of the drawer unlocking mechanism, so that at the time when the card restraining pin engages in the openings of the register cards remaining in the housing, the drawer is unlocked and is moved out of the housing with the selected card and the stack of cards located below the same.

Furthermore, the data register housing has very small dimensions which is also achieved through providing slot-shaped recesses in the rear end area of the drawer which correspond to the bent portions carrying the card restraining pin at the ends of the swivel levers, so that in the drawer insertion, said bent portions rest in the slot-shaped recesses. Thus, the drawer can have large dimensions, so that the entire bearing surface of the drawer is available for the stack of register cards, so that large cards can be used.

The invention is described hereinafter with reference to an embodiment and to the attached drawings, wherein show:

FIG. 1 a diagrammatic view of a data register.

Figure 2:
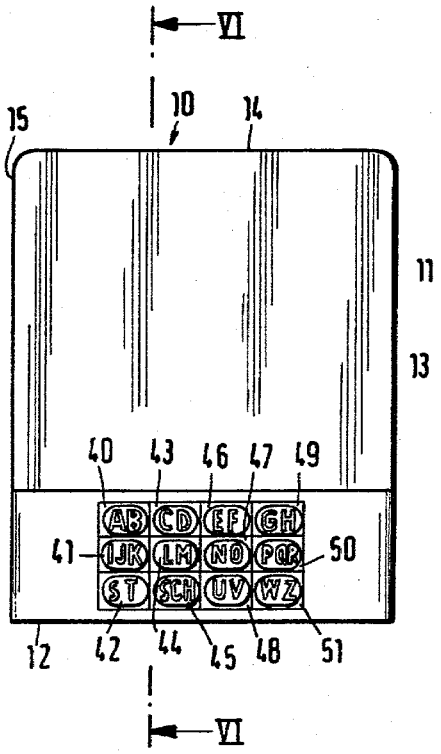

FIG. 2 a plan view of a data register.

Figure 3:
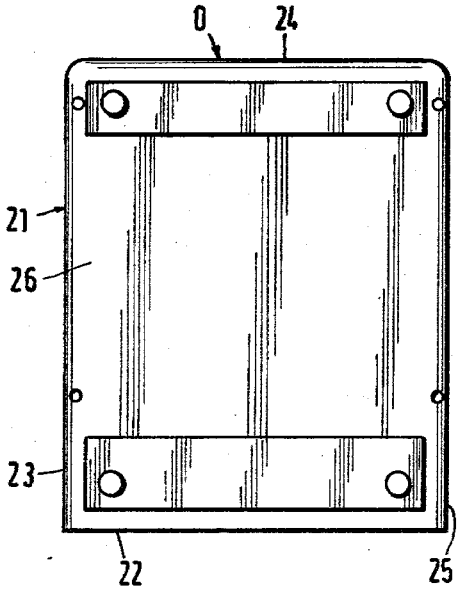

FIG. 3 a data register from the rear.

Figure 4:
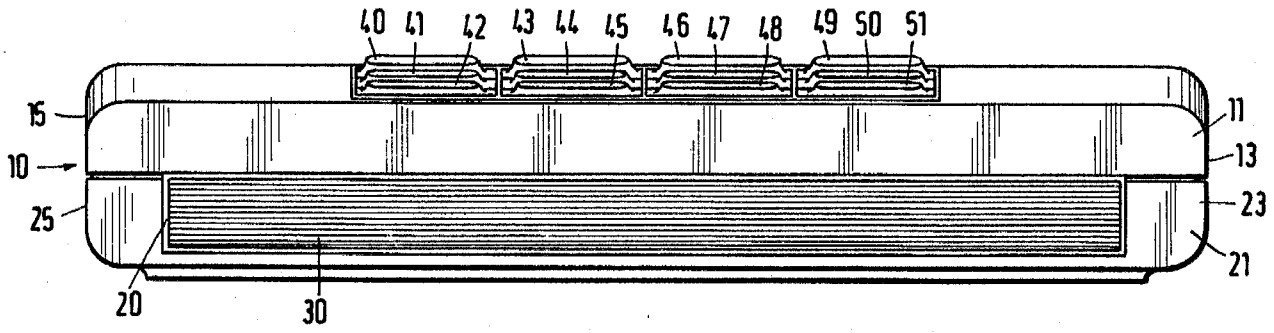

FIG. 4 a plan view of a data register in the original size.

Figure 5:
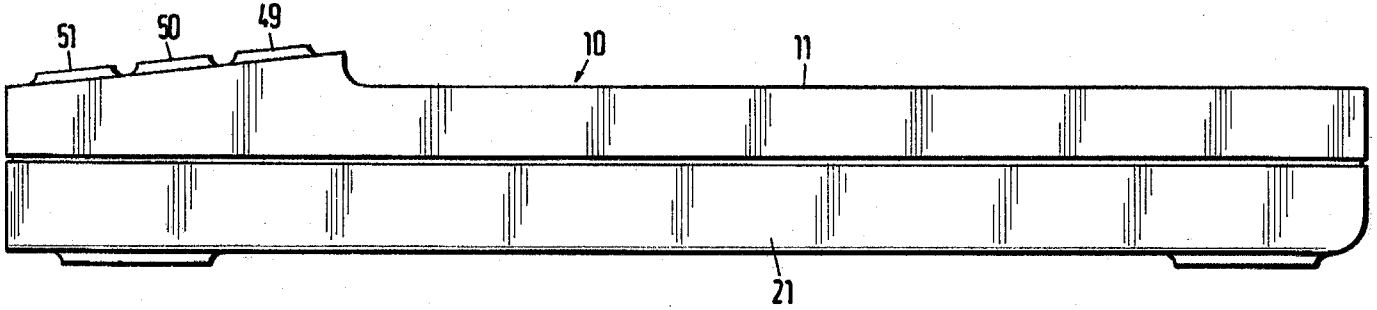

FIG. 5 a view from the side of the data register.

Figure 6:
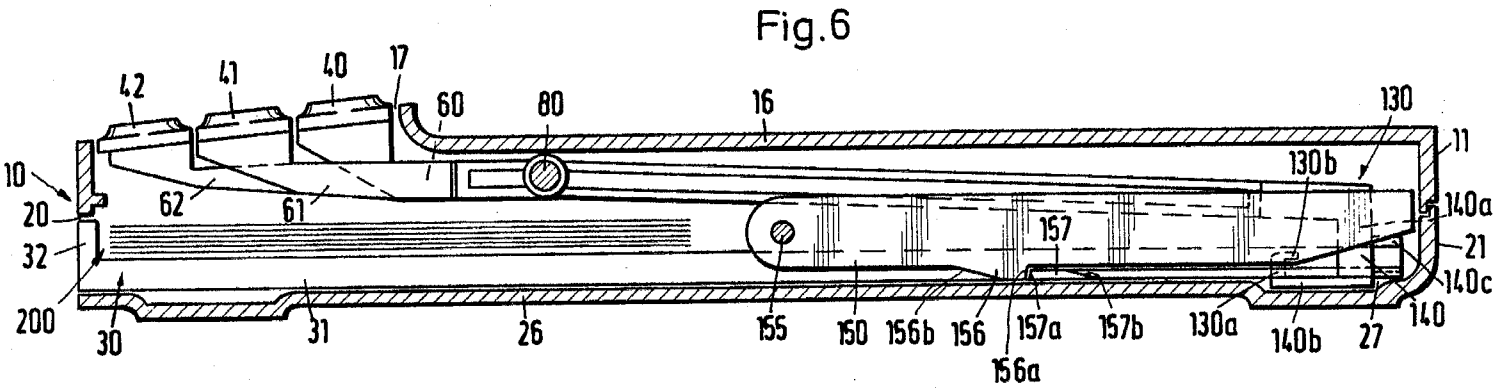

FIG. 6 a vertical section along the line VI—VI of FIG. 2.

Figure 7:
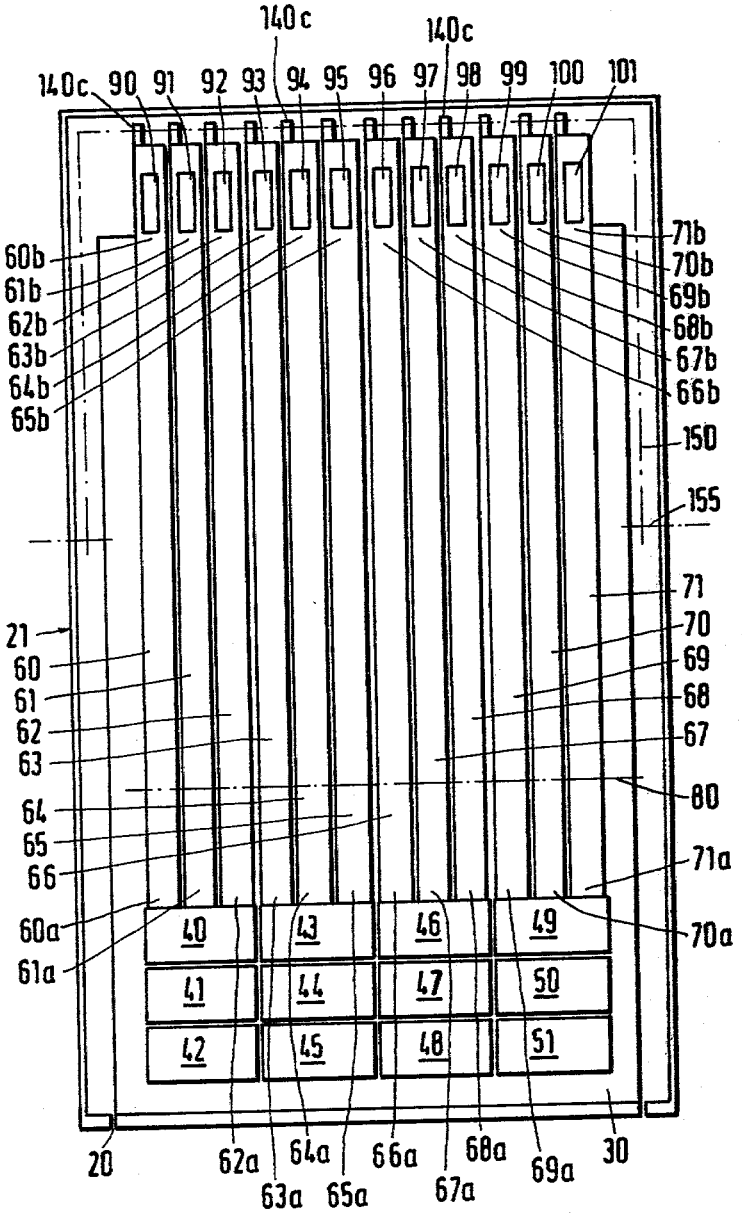

FIG. 7 the data register with the cover removed and inserted drawer in plan view.

Figure 8:
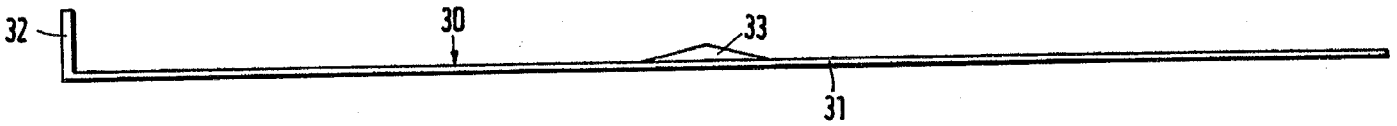

FIG. 8 a side view of the drawer.

Figure 9:
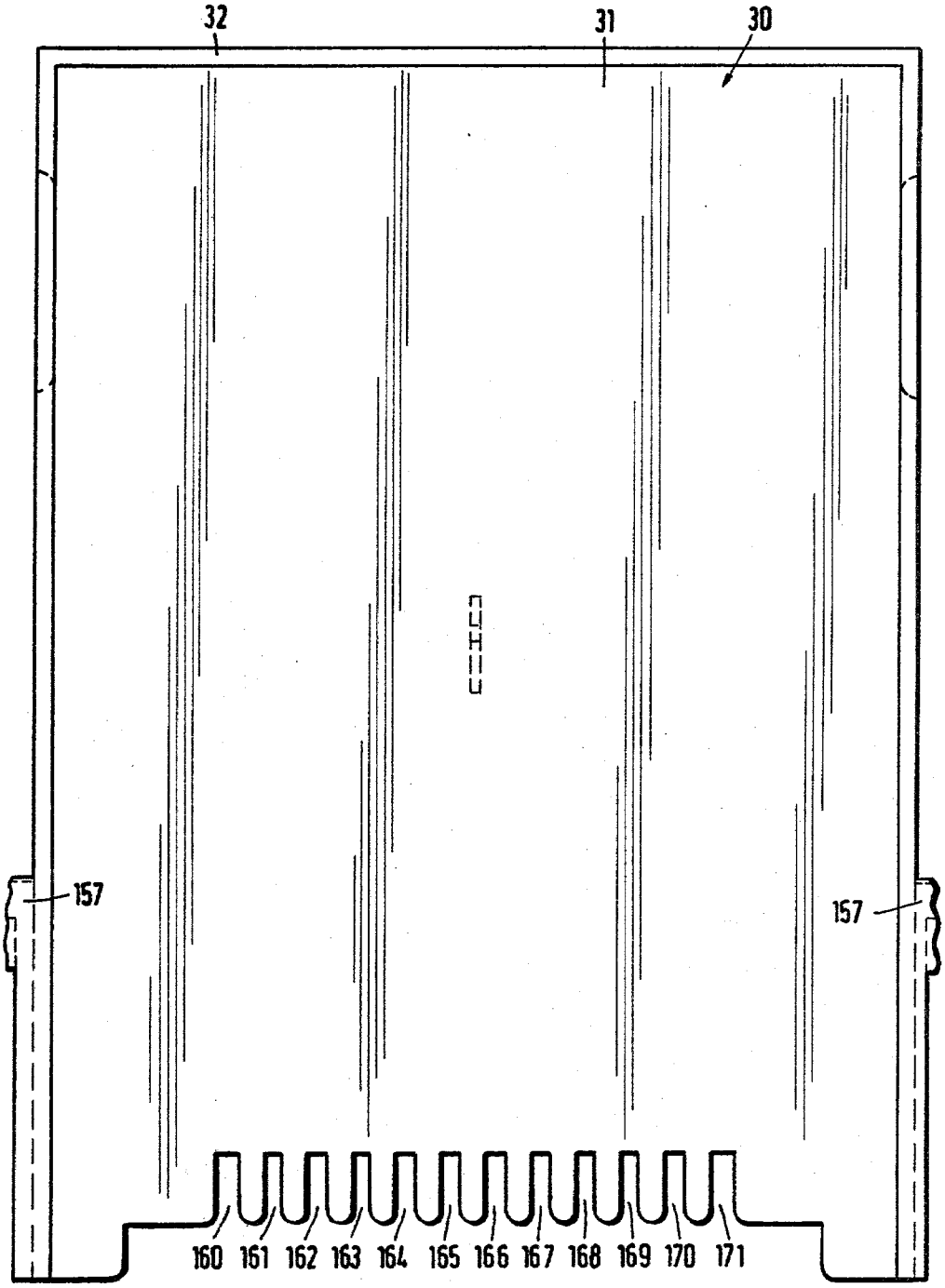

FIG. 9 a plan view of the drawer in the original size.

Figure 10:
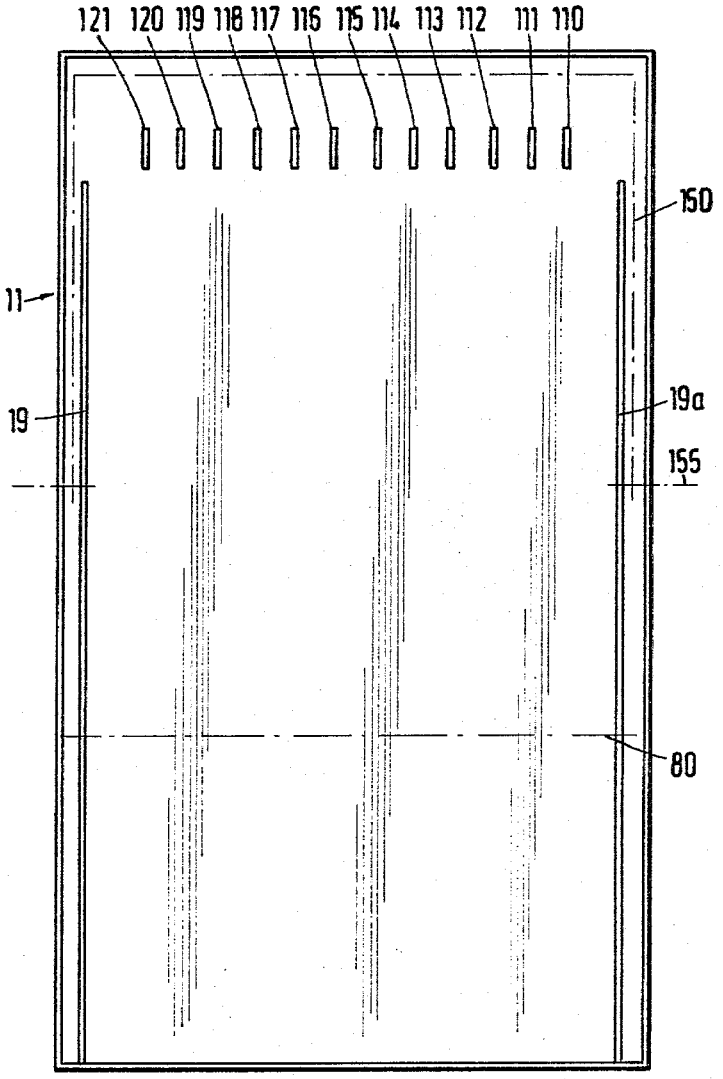

FIG. 10 the housing cover in a view from the inside.

Figure 11:
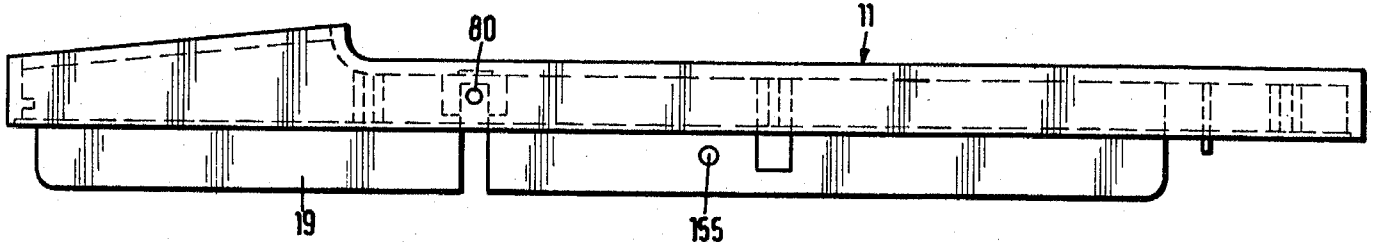

FIG. 11 a side view of the housing cover.

Figures 12, 13:
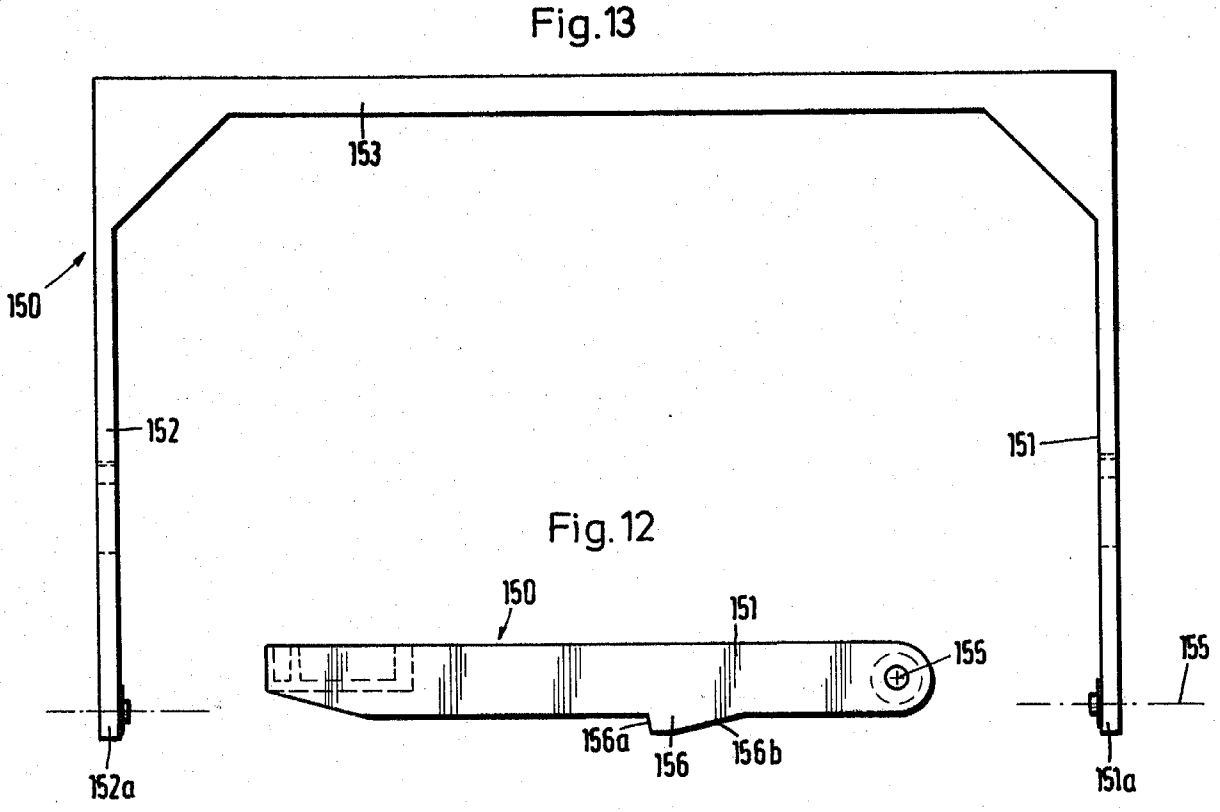

FIG. 12 a side view of the shackle which operates the drawer unlocking device.

FIG. 13 a plan view of the shackle.

Figure 14:
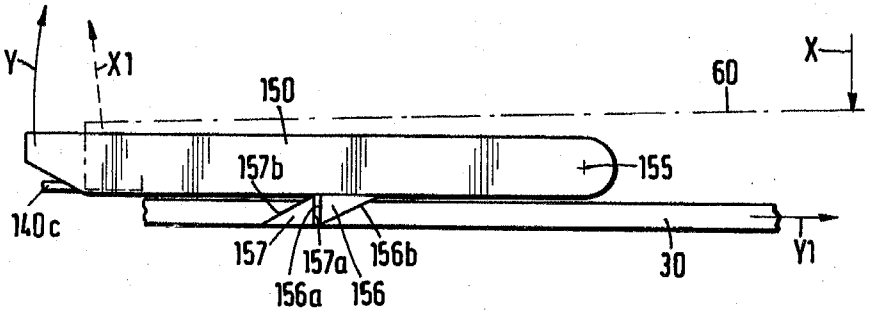

FIG. 14 the cooperation between shackle, swivel lever and drawer in a diagrammatic side view.

Figure 15:
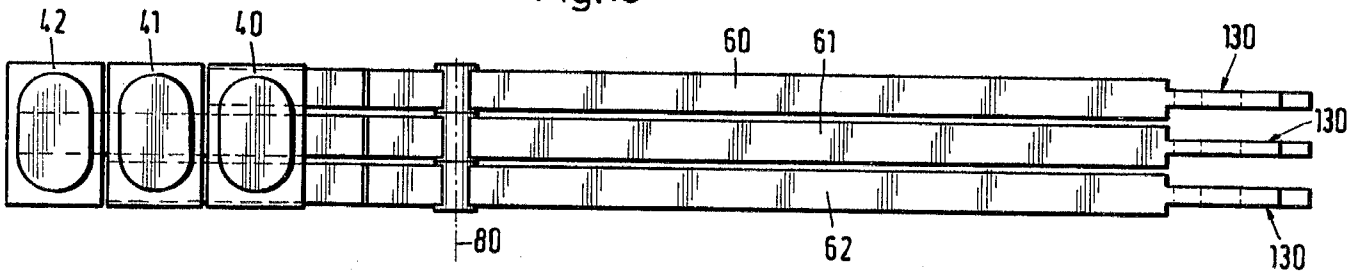

FIG. 15 a plan view of three selector keys with three swivel levers.

Figure 16:
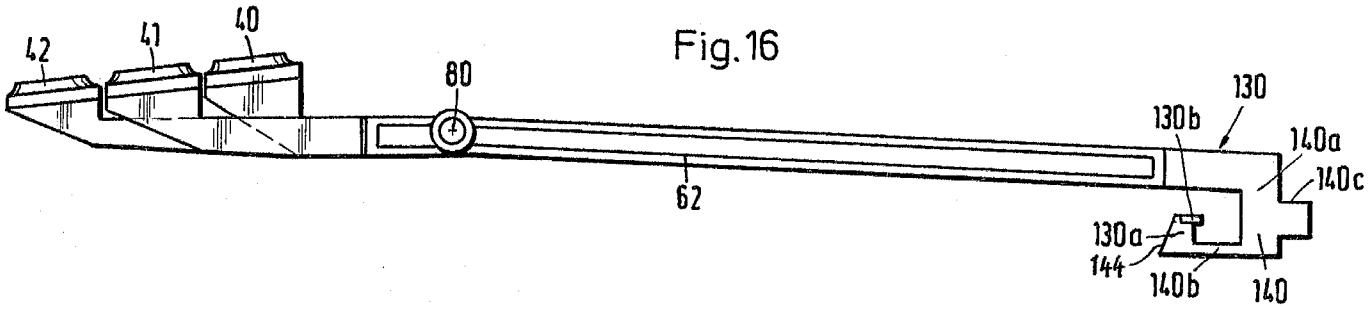

FIG. 16 a side view of the three selector keys with the swivel levers according to FIG. 15.

Figure 17:
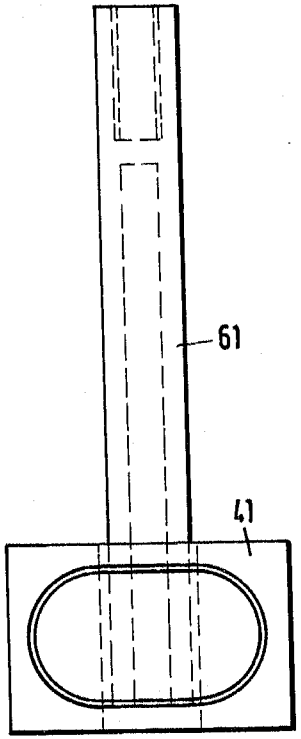

FIG. 17 an enlarged view of the central selector key of the three keys of FIG. 15.

Figure 18:
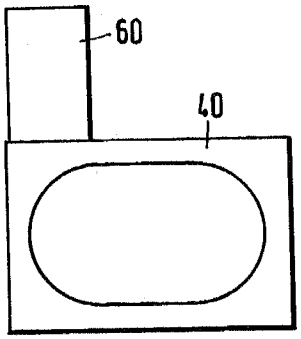

FIG. 18 an enlarged view of the rearmost selector key of the three keys of FIG. 15.

Figure 19:
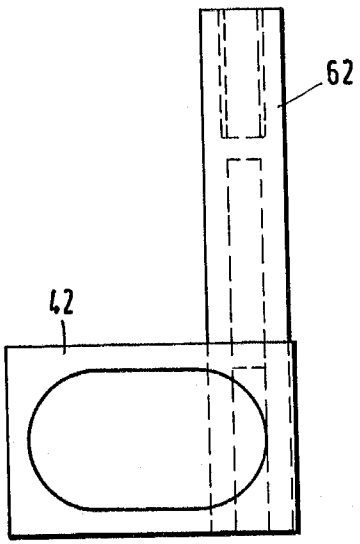

FIG. 19 an enlarged view of the front selector key of the three keys of FIG. 15.

Figure 20:
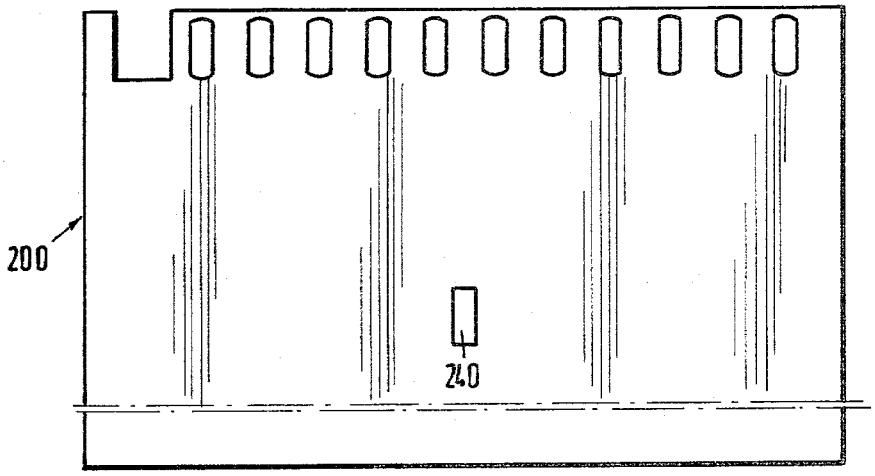

FIG. 20 a plan view of a stack of register cards.

Figure 21:
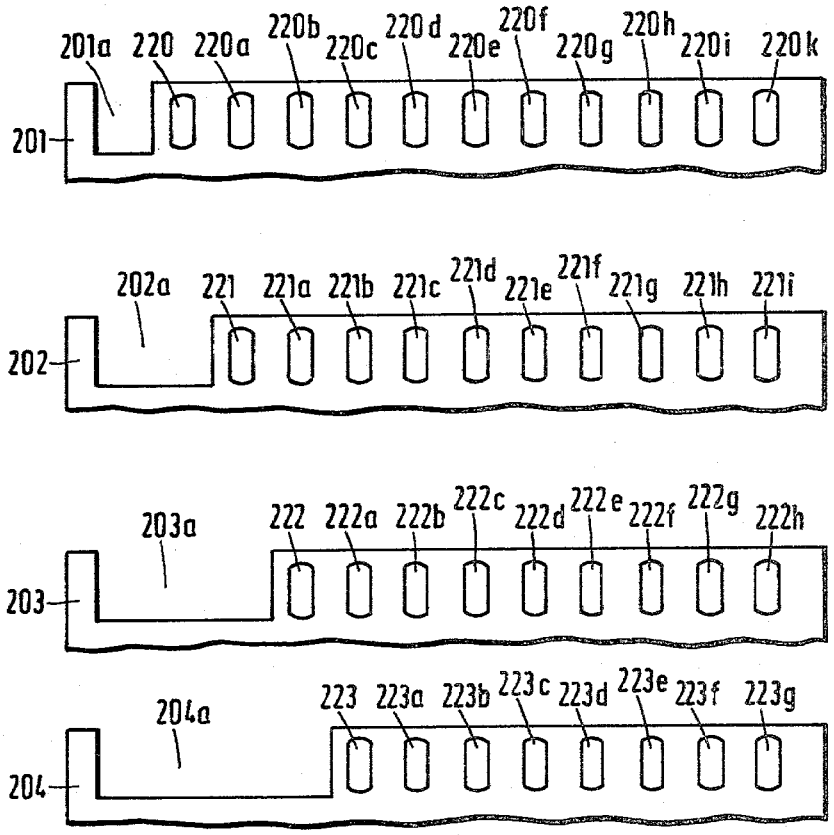
Figure 21A:
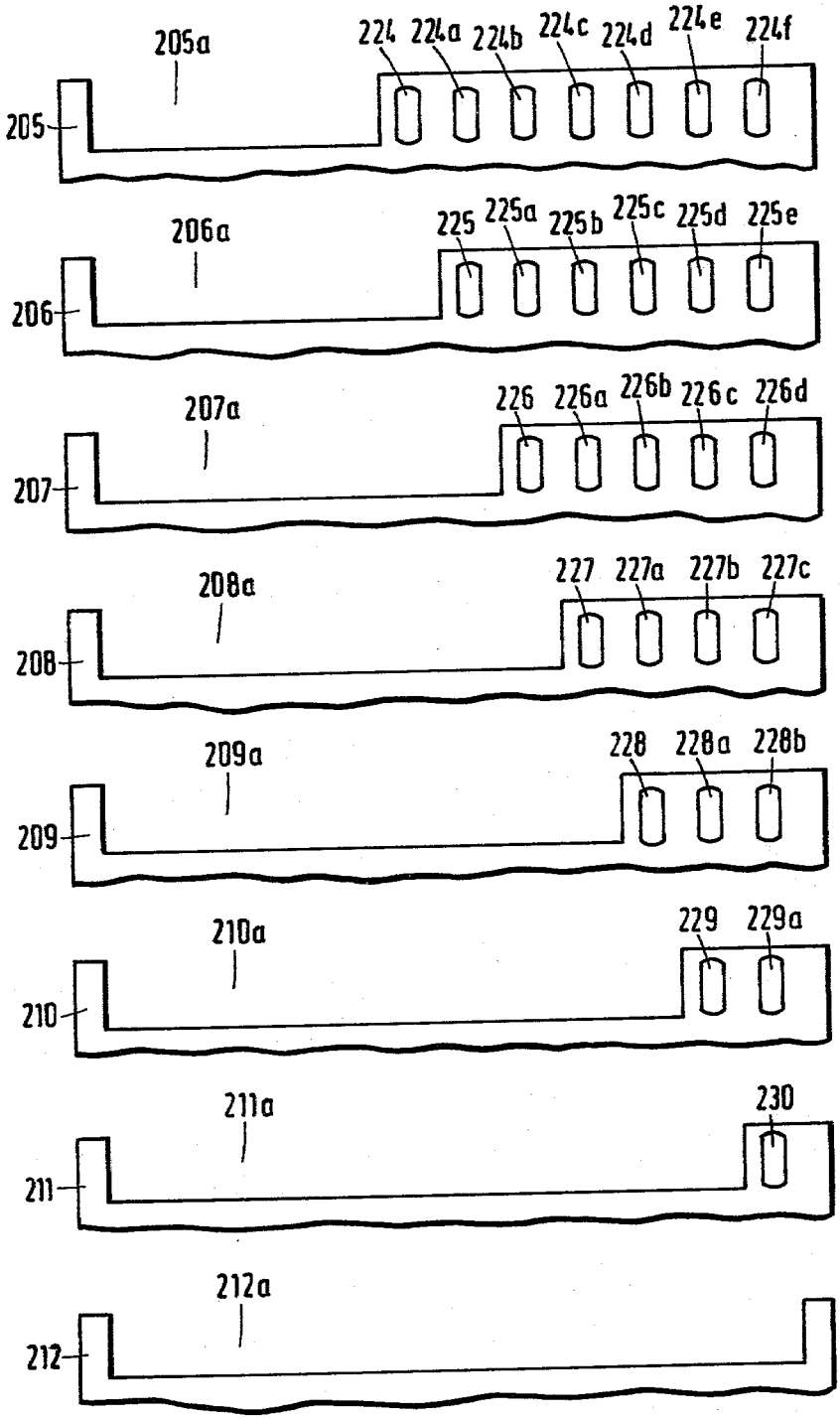

FIGS. 21 and 21A the front portions of the register cards arranged one behind the other with openings and recesses in the rear portion for the card restraining pin in plan view.

The data register shown in FIGS. 1 to 5 comprises a housing 10 with a box-shaped cover 11 and a box-shaped base 21. Cover 11 and base 21 are interconnected by means of screw or adhesive connections and are preferably made from plastic. The cover 11 with side walls 13 and 15, front wall 12 and rear wall 14 has an upper cover plate 16 in which an approximately square or rectangular opening 17 is formed in the vicinity of front wall 12. The portion of upper cover plate 16 carrying opening 17 slopes in a slightly desk-shaped manner. The remaining area of cover plate 16 can be provided with a non-slip layer and have a side which serves as a bearing surface for a telephone or the like.

Base 21 with side walls 23 and 25, front wall 22 and rear wall 24 has a base plate 26 and a slot-shaped opening 27 in front wall 22 which serves to receive a drawer 30.

The base 21 of housing 10 receives the drawer 30 which comprises a plate-shaped drawer base 31 and a front terminal strip 32 which, when drawer 30 is inserted, seals the drawer removal opening 20 in the front wall 22 of base 21. Drawer base 31 has a cam 32 in its centre and on its top (FIGS. 8 and 9). The side walls of drawer 30 are formed by two limiting walls 19 and **19*a* which are shaped onto the inside of housing cover 11 (FIGS. 10 and 11**).

For the purpose of extending drawer 30, a steel spring rod, not shown in the drawing, is arranged on base plate 26 of base 21 in such a way that its one free end is connected to the plate-shaped drawer base 31, whilst the other end thereof is rigidly connected with base plate 26 of base 21. The action of the steel spring corresponds to that of a thrust spring which is placed under tension on inserting drawer 30 into base 21 of housing 10 so that on unlocking drawer 30 the drawer is extended by means of the steel spring rod which springs back into its initial position.

A plurality of square or rectangular selector keys is arranged in the area of opening 17 in upper cover plate 16 of cover 11 of housing 10, the arrangement being such that the total area formed by the selector keys fills the opening 17 in cover 11.

In the embodiment shown in FIGS. 1 and 2, twelve selector keys 40, 41, 42, 43, 44, 45, 46, 47, 48, 49, 50 and 51 are provided which are correspondingly marked and in fact with the letters of the alphabet in such a way that selector key 40 carries letters "A,B" key 41 letters "I,J,K", key 42 letters "S,T" key 43 letters "C,D", key 44 letters "L,M", key 45 letters "Sch", key 46 letters "E.F", key 47 letters "N,O", key 48 letters "U,V", key 49 letters "G,H", key 50 letters "P,Q,R", and key 51 letters "W,Z". The twelve selector keys 40 to 51 are juxtaposed in three rows and arranged one behind the other in four rows, so that keys 40, 41, 42 and 43, 44, 45 and keys 46, 47, 48 and 49, 50, 51 in each case form one row.

Keys 40 to 51 are connected to a number of lever-like swivel arms 60, 61, 62, 63, 64, 65, 66, 67, 68, 69, 70 and 71 corresponding to the number of keys and on whose ends 60*a*, 61*a*, 62*a*, 63*a*, 64*a*, 65*a*, 66*a*, 67*a*, 68*a*, 69*a*, 70*a* and 71*a* are fixed selector keys 40 to 51, whilst the other ends of swivel lever 60 to 71 are designated by 60*b*, 61*b*, 62*b*, 63*b*, 64*b*, 65*b*, 66*b*, 67*b*, 68*b*, 69*b*, 70*b* and 71*b* (FIG. 7). Swivel levers 60 to 71 are constructed as two-armed levers and are mounted in swivellable manner by means of a swivel axis of the side walls 13 and 15 of cover 11 in such a way that swivel levers 60 to 71 are provided centrally with openings which are at right angles to the longitudinal axes of the swivel levers and through which is passed swivel axis 80 in such a way that swivel letters 60 to 71 are arranged so as to swivel freely on swivel axis 80.

In the area of its ends 60*b* to 71*b*, each swivel lever 60 to 71 has a vertical slot-shaped opening 90, 91, 92, 93, 94, 95, 96, 97, 98, 99, 100 and 101 in which engage guide cams 110, 111, 112, 113, 114, 115, 116, 117, 118, 119, 120 and 121 shaped onto the inner wall surface of the upper cover plate 16 of cover 11 (FIG. 10). The length of guide cams 110 to 121 is dimensioned in such a way that the free ends 60*b* to 71*b* of swivel lever 60 to 71 with their slot-shaped 90 to 101 are guided by means of said cams 110 to 121 so that a lateral displacement of the swivel lever ends 60*b* to 71*b* is prevented. The arrangement offers the further advantage that it is no longer necessary to fix the swivel levers 60 to 71 on pivot axis 80 to prevent any displacement.

The selector keys 40 to 51, which comprise plate-shaped square or rectangular blanks and which are advantageously fixed by means of vertical webs to the ends 60*a* to 71*a* of swivel levers 60 to 71 have a width which is such that the width formed by the sum of the selector keys 40, 43, 46, 49 and 41, 44, 47, 50 and 42, 45, 48, 51, which are juxtaposed in rows, is no wider than the total width formed by the swivel levers 60 to 71. The arrangement of the selector keys 40 to 51 on swivel levers 60 to 71 is explained relative to FIGS. 15 to 19 by using the example of selector keys 40, 41 and 42. Selector keys 40 to 42 are arranged one behind the other in a row and fixed to the ends 60*a*, 61*a* and 62*a* of swivel levers 60, 61 and 62. Selector key 40 is fixed to the end 60*a* of swivel lever 60 in such a way that the plate-shaped blank of key 40 projects to the right over the adjacent swivel levers 60, 61, 62, whereby the width of key 40 corresponds to the width of the three swivel levers 60, 61, 62. Selector keys 41, 42 also have widths which in each case correspond to the width of the three swivel levers 60, 61, 62. The central selector key 41 is fixed to the swivel lever end 61*a* in such a way that the plate-shaped selector key blank projects to both sides and the adjacent swivel levers 60 and 62 are overlapped by it. The front selector key 42 is fixed to swivel lever end 62*a* in such a way that its plate-shaped blank projects to the left and projects over the two swivel levers 60, 61 (FIGS. 17, 18 and 19). Selector keys 43, 44, 45 and 46, 47, 48 and 49, 50, 51 are fixed to their swivel levers 63 to 71 in the same way as selector keys 40, 41, 42.

The end 60*b* to 71*b* of each swivel lever 60 to 71 carries a card restraining pin 130 (FIG. 6). Each of these card restraining pins 130 is formed by a U-shaped portion 140 with webs 140*a* and leg 140*b* which is parallel to the swivel lever end. The other leg of the U-shaped portion 140 is formed by the end portion 60*b* or 61*b* to 71*b* of the individual swivel levers 60 to 71.

The free end of leg 140*b* of U-shaped portion 140 of card restraining pin 130 carries a vertical rod 130*a* which constitutes the actual card restraining pin. The arrangement and construction of the card restraining pins 130 on swivel lever ends 60*b* to 71*b* are such that on operating one swivel lever by depressing the corresponding selector key the rear end of the swivel lever is raised, whereby simultaneously rod 130*a* of U-shaped portion 140 of the relevant swivel lever is raised and as will be explained in greater detail hereinafter engages in the openings or recesses on the rear edges of the register cards of the stack of register cards located in drawer 30, as intimated at 200 in FIG. 6.

In order that the data register has a limited height, a recess 27 (FIG. 6) is provided in base plate 26 of base 21 in the area of the bearing surface of U-shaped portions 140 of card restraining pins 130. The depth of recess 21 approximately corresponds to the height of webs 140*b* of the U-shaped portions 140 of card restraining pins 130, whereby however the depth of recess 27 can also be larger. Recess 27 must be constructed in such a way and the association of swivel axis 80 for swivel levers 60 to 71 must be such that the swivel levers are slightly inclined in the inoperative position as shown in FIG. 6. In this inoperative position, the webs 140*b* of U-shaped portions 140 of card restraining pins 130 are supported on the base surface of recess 27. This construction ensures a perfect engagement of rod 130*a* of card restraining pins 130 in the openings in the rear edge areas of the cards of the stack 200 of register cards. In addition, the individual rods 130*a* can be provided with a rear bent portion 130*b*, but its surface area must be no larger than the openings provided in the edge areas of the register cards. This rear bent portion 130*b* of rods 130 prevent, on extending drawer 30, any lifting of those cards which are located below the selected card and are moved out with drawer 30. This construction of rod 130 is particularly advantageous in the case of register cards which following prolonged use are no longer flat.

In order to be able to extend drawer 30 after operating a selector key, an unlocking mechanism is provided which is actuated by means of a swivel shackle 150 (FIGS. 12, 13 and 14). This swivel shackle 150 is a U-shaped shackle with legs 151 and 152 and a rod 153 which interlinks said legs. At the ends 151*a* and 152*a* of legs 151 and 152, the swivel shackle 150 is articulated to the outer wall surfaces of the vertical limiting walls 19 and 19*a*, which are shaped onto the cover 11 (FIG. 10). However, the possibility exists of articulating swivel shackle 150 with its leg ends 151*a* and 152*a* to the inner wall surfaces of side walls 23 and 25 of base 21. The swivel shackle 150 is fixed in such a way that it can be swivelled about the swivel axis indicated at 155 in FIG. 10. In addition, swivel shackle 150 is arranged in such a way that when the data register is not in use, web 153 of shackle 150 rests on swivel levers 60 to 71 namely in the area of their ends 61*b* to 71*b*. However, the possibility also exists of extending the leg 140*b* of U-shaped portion 140 of card restraining pins 130 over and beyond the vertical web 140*b* (FIG. 6). The complete extended portions 140*c* then serve as a bearing surface for web 153 of U-shaped swivel shackle 150 leading to the advantage that the housing 10 of the data register has only a limited height. On operating a selector key, only a limited lift is then required for raising the swivel shackle 150.

As shown in FIG. 14, the drawer unlocking mechanism comprises a locking cam 156 shaped onto the bottom of each leg 151 and 152 of swivel shackle 150. Locking cam 156 comprises an approximately triangular body with an approximately vertical stop face 156*a* facing the rear wall of housing 10. Counter-cams 157 shaped onto the drawer bottom 31 on either side thereof engage with stop face 156*a*. Each of the counter-cams 157 is constructed as a triangular body with a vertical edge 157*a* facing the front of housing 10.

According to FIG. 14, the operation of the drawer unlocking mechanism is such that on operating a selector key in the direction of arrow X, the free end of the swivel lever carrying the card restraining pin 130 is swivelled upwards in the direction of arrow $X_1$ and simultaneously swivel shackle 150 is swivelled upwards in the direction of arrow Y. During the swivelling of swivel shackle 150 in the direction of arrow Y, the two locking cams 156 on legs 151 and 152 of swivel shackle 150 are disengaged from the counter cams 157 of drawer 30 so that under spring tension drawer 30 can be extended in the direction of arrow $Y_1$. If after examining a register card, drawer 30 has once again to assume a position within housing 10, it is inserted counter to the tension of the spring until the counter-cams 157 and drawer 30 engage behind the locking cams 156 on swivel shackle 150, whereby the latter assumes its inoperative position. By inserting drawer 30 into housing 10, counter-cams 157 are assisted in sliding past the locking cams 156 by the wedge-shaped guide surfaces 156*b* and 157*b* of cams 156 and counter-cams 157. When on inserting drawer 30, its counter-cams 157 have assumed their position behind the locking cams 156 of swivel shackle 150, the latter moves into its lowermost position due to its own weight or aided by a spring and thus locks drawer 30.

In order that in the inserted position, drawer 30 offers a maximum bearing surface for the stack 200 of register cards, the plate-shaped drawer base 31 has a number of slot-shaped recesses 160 to 171 corresponding to the number of card restraining pins 130. The length of each slot-shaped recess 160 to 171 corresponds to the length of leg 140*b* of U-shaped portion 140 of each card restraining pin 130, so that in the inoperative position of swivel lever 60 to 71 the U-shaped portions 140 with their legs 140*b* extending in the direction of the front of housing 10 come to rest in the slot-shaped recesses 160 to 171. Due to this construction, swivel levers 60 to 71 are aligned in the inner area of housing 10, so that on actuating a selector key the corresponding card restraining pin can engage without any lateral displacement in the openings on the rear edge areas of the register cards.

The stack 200 of register cards arranged in housing 10 has a number of register cards 201 to 212 corresponding to the number of selector keys 40 to 51, whereby card 201 is the uppermost card and card 212 is the lowermost card in stack 200 (FIGS. 20, 21, 21*a*).

Each card 201 to 212 is provided with a marginal recess and with a plurality of slot-shaped openings, whereby the marginal recess extends from the uppermost card 201 to the lowermost card 212 from the left-hand to the right-hand side of the card, accompanied by the simultaneous enlargement of the marginal recess by in each case one slot-shaped opening with the simultaneous reduction in the number of slot-shaped openings from the top card 201 to the bottom card 212. As shown in FIGS. 21 and 21*a*, slot-shaped recesses 201*a* to 212*a* are provided in the rear marginal areas of register cards 201 to 212. Each register card 201 to 212 has one recess 201*a* to 212*a*. In addition to in each case one recess 201*a* to 212*a*, each card right down to the bottom card 212 is provided with a plurality of slot-shaped openings, whereby the number of said openings decreases by in each case one opening from the top card 201 to the penultimate card 211, so that finally card 212 has no opening and instead only a single recess 212*a* which extends from recess 201*a* of card 201 to the opening in card 211.

In addition to marginal recess 201*a*, register card 201 has eleven openings 220, 220*a*, 220*b*, 220*c*, 220*d*, 220*e*, 220*f*, 220*g*, 220*h*, 220*i*, 220*k*, card 202 in addition to the double width recess 202*a* ten openings 221, 221*a*, 221*b*, 221*c*, 221*d*, 221*e*, 221*f*, 221*g*, 221*h* and 221*i*. card 203 in addition to recess 203*a* nine openings 222, 222*a*, 222*b*, 222*c*, 222*d*, 222*e*, 222*f*, 222*g* and 222*h*, card 204 in addition to recess 204*a* eight openings 223, 223*a*, 223*b*, 223*c*, 223*d*, 223*e*, 223*f* and 223*g*, card 205 in addition to marginal recess 205*a* seven openings 224, 224*a*, 224*b*, 224*c*, 224*d*, 224*e* and 224*f*, card 206 in addition to recess 206*a* six openings 225, 225*a*, 225*b*, 225*c*, 225*d* and 225*e*, card 207 in addition to marginal recess 207*a* five openings 226, 226*a*, 226*b*, 226*c*, 226*d*, card 208 in addition to recess 208*a* four openings 227, 227*a*, 227*b*, 227*c*, card 209 in addition to recess 209*a* three openings 228, 228*a* and 228*b*, card 210 in addition to recess 210*a* two openings 229 and 229*a*, register card 211 in addition to recess 211*a* one opening 230 and card 212 a single recess 212*a* extending over the entire width of the card.

The openings formed in the marginal areas of register card 201 to 211, as well as marginal recesses 201 to 212 are formed and arranged in such a way that the recesses and openings of the superimposed cards are aligned.

Therefore, the selection of a register card takes place in such a way that on operating a selector key by means of the swivellable swivel lever, the card restraining pin with its rod 130 engages from below into the recesses and the superimposed openings, so that, extending the drawer, all the register cards are held back which are located above the selected card, this being effected by the rod 130*a* which is passed through the opening, whilst the other card positioned below it can be moved out with the drawer, because rod 130 is passed through the recesses below the openings of the superimposed cards and is therefore unable to hold back these cards.

Register cards 201 to 212 are made from cardboard, pasteboard or the like and can be provided with corresponding line guides, fields and the like. In addition, each register card 201 to 212 carries those letters corresponding to the letters of the alphabet which appear on the selector key associated with the corresponding card. Thus, card 201 is provided with letters "A,B", card 202 with letters "S,T", card 203 with letters "I,J,K", card 204 with letters "C,D", card 205 with letters "Sch", card 206 with letters "L,M", card 207 with letters "E,F", card 208 with letters "U,V", card 209 with letters "N,O", card 210 with letters "G,H", card 211 with letters "W,Z", and card 212 with letters "P,Q,R".

As shown in FIG. 20, all the register cards 201 to 202 have a slot-shaped opening 240 in the centre thereof in which engages the cam 33 on the plate-shaped draw bottom 31. Cam 33 is also triangular, so that the cards to be moved out with the drawer are seized by cam 33 and can be carried along, whilst the cards held back by card restraining pins 130 cannot be carried along by cam 33.

Each of the card restraining pins shows in the area of its vertical upward bent portion 130*a* a diagonal formed surface 144. This surface 144 guarantees that by the practice of a swivel lever the card restraining pin completely will engage in the provided slot-shaped opening in the rear area of the register card.

I claim:

1. A data register with a register card selection mechanism comprising a housing which has a cover and a base with a plurality of selector keys which are juxtaposed and superimposed in rows and a drawer which is under the action of a compression spring and which is closable by means of a locking mechanism, whereby a large number of register cards are stacked in said drawer with selection tongues having openings formed in the rear edge portions thereof, said tongues increasing in size in step-like manner by, in each case, one opening-containing selection tongue from one side to the other side of the register card with the first opening disposed opposite the first opening of the preceeding register card, whereby each selection key is fixed to a swivel arm constructed as a lever which at its free end carries a card restraining pin, whereby the card restraining pins of swivel levers are arranged in a row and cooperate with the register cards in such a way that, on depressing a selector key, all register cards located above the register card associated with this selector key are held back on extending the drawer by inserting the card restraining pins into the openings of the selection tongues of the register cards, while the selected register card and all the cards located below it are moved out with the drawer, as well as a device operable by the swivel levers of the selector keys for unlocking the drawer and releasing the register cards selected by a selector key by forcing out the unlocked drawer by means of the compression spring and provided with a cam for engaging with cam perforations on the register card, wherein the card restraining pin of each swivel lever comprises an approximately U-shaped portion shaped onto the end of the swivel lever with a leg leading to the selector keys onto whose end is shaped a vertically upwardly directed rod which on operating a swivel lever engages from below into the register card opening or recess, wherein the improvement comprises that said vertically upwardly directed rod of said U-shaped portion of said card restraining pin has an upwardly extending diagonally formed surface facing toward said selection keys and said diagonally formed surface extending obliquely upwardly relative to the vertical direction, and said vertically upwardly directed rod has a rear bent portion extending transversely of the upper part of said rod in the direction opposite to the direction in which said diagonal formed surface faces and said rear bent portion being smaller than the openings formed in the rear edge portions of said register cards.

* * * * *